US005527489A

United States Patent [19]

Tadsen et al.

[11] Patent Number: 5,527,489

[45] Date of Patent: Jun. 18, 1996

[54] PROCESS FOR PREPARING HIGH DENSITY DETERGENT COMPOSITIONS CONTAINING PARTICULATE PH SENSITIVE SURFACTANT

[75] Inventors: Richard L. Tadsen; Gary W. Bufler, both of Cincinnati, Ohio

[73] Assignee: The Procter & Gamble Company, Cincinnati, Ohio

[21] Appl. No.: 164,420

[22] Filed: Dec. 7, 1993

Related U.S. Application Data

[63] Continuation of Ser. No. 941,844, Sep. 8, 1992, abandoned, which is a continuation of Ser. No. 590,421, Oct. 3, 1990, abandoned.

[51] Int. Cl.[6] ..... C11D 11/02; C11D 11/04; C11D 17/06

[52] U.S. Cl. ..... 252/174; 252/89.1; 252/174.14; 252/174.25; 252/525; 252/529; 252/531; 252/532; 252/534; 252/535; 252/539; 252/540; 252/544; 252/548; 252/550; 252/551; 252/553; 252/554; 252/558; 252/559; 252/DIG. 16

[58] Field of Search ..... 252/174, 89.1, 252/174.14, 174.25, 135, 539, 540, 531, 532, 534, 535, 558, 559, 550, 551, 553, 554, 529, 548, DIG. 16, 525, 544

[56] References Cited

U.S. PATENT DOCUMENTS

| | | | |
|---|---|---|---|
| 2,965,576 | 12/1960 | Wilson | 252/529 |
| 3,178,370 | 4/1965 | Okenfuss | 252/529 |
| 4,478,735 | 10/1984 | Yazaki | 252/140 |
| 4,515,707 | 5/1985 | Brooks | 252/368 |
| 4,524,010 | 6/1985 | Reuter et al. | 252/135 |
| 4,544,493 | 10/1985 | Silvis | 252/89.1 |
| 4,652,392 | 3/1987 | Baginski et al. | 252/109 |
| 4,664,848 | 5/1987 | Oh et al. | 252/547 |
| 4,690,785 | 9/1987 | Mausner et al. | 562/97 |
| 4,715,979 | 12/1987 | Moore et al. | 252/91 |
| 4,734,224 | 3/1988 | Barrett | 252/558 |
| 4,767,557 | 8/1988 | Herdemann | 252/91 |
| 4,919,847 | 4/1990 | Barletta | 252/174.14 |
| 4,925,585 | 5/1990 | Strauss | 252/174 |

FOREIGN PATENT DOCUMENTS

| | | |
|---|---|---|
| 339996-A | 11/1989 | European Pat. Off. . |
| 351937-A | 1/1990 | European Pat. Off. . |
| 352135-A | 1/1990 | European Pat. Off. . |
| 2206381 | 6/1974 | France . |
| 256854 | 2/1986 | France . |
| 60-72999 | 4/1985 | Japan . |
| 01/121400 | 5/1989 | Japan . |
| 1369269 | 10/1974 | United Kingdom . |
| 1404317 | 8/1975 | United Kingdom . |
| 1408969 | 10/1975 | United Kingdom . |
| 2166452A | 5/1986 | United Kingdom . |
| 2221695 | 2/1990 | United Kingdom . |

OTHER PUBLICATIONS

Synthetic Detergents, Davidsohn, A. S. & Milwidsky, B., 1987, 7th Ed. Chapter 6, pp. 200–209 and 231–233. *no month available.

Journal of the American Oil Chemists Society, vol. 55, No. 1, pp. 141–143 (1978), "Agglomeration–The Practical Alternative". *no month available.

Soap & Chemical Specialties, Dec., 1968, Reprint 900–D–1, "Detergent Production with Novel Blenders". *no month available.

*Primary Examiner*—Paul Lieberman
*Assistant Examiner*—A. Hertzog
*Attorney, Agent, or Firm*—Milton B. Graff; Daniel F. Nesbitt; Donald E. Hasse

[57] ABSTRACT

A process for preparing a high-density granular detergent product by dry neutralizing alkylbenzene sulfonic acid with a particulate mixture of a water-soluble alkaline inorganic material, for example, sodium carbonate, and a hydratable inorganic detergent builder in an apparatus which provides both mixing and shearing of the particulate mixture, e.g. a V-Blender, thereby forming the granular detergent product. The process includes the addition of particles of pH sensitive detergent surfactant, such as alkyl sulfate, into the particulate mixture prior to the addition of the alkylbenzene sulfonic acid. The high-density product has good product homogeneity and surfactant solubility, and essentially no reversion of the alkyl sulfate to the corresponding fatty alcohol due to acid-catalyzed hydrolysis. Other pH sensitive detergent surfactants include alpha-sulfonated fatty acid alkyl ester and polyhydroxy fatty acid amides.

20 Claims, No Drawings

PROCESS FOR PREPARING HIGH DENSITY DETERGENT COMPOSITIONS CONTAINING PARTICULATE PH SENSITIVE SURFACTANT

This is a continuation of application Ser. No. 07/941,844, filed on Sep. 8, 1992, now abandoned, which in turn was a continuation of application Ser. No. 07/590,421, filed on Oct. 3, 1990, now abandoned.

BACKGROUND OF THE INVENTION

The present invention is related to a high-density granular detergent composition and a product made therefrom, and to a dry neutralization process for preparing the granular detergent composition.

There has recently been considerable interest in the detergent field in high-density detergent powders having a high surfactant active level. These concentrated products can be packaged in smaller containers to provide savings in manufacturing and shipping over conventional spray-dried products, and their compact size is appreciated by consumers.

Numerous methods of making high density, high active granular detergent products have been suggested in the past, including dry neutralization processes. European Patent Publication 0,352,135 (Unilever) discloses a process comprising the steps of neutralizing a detergent acid (eg, linear alkylbenzene sulfonic acid) with a particulate water-soluble alkaline inorganic material (eg, carbonate) in equipment which provides both a stirring and a cutting action (eg, a Fugae or a Lodige), while maintaining the temperature of the product at 55° C. or less. Also disclosed is the addition of powdered surfactant to the process prior to the addition of the sulfonic acid.

Great Britain Patent Publication No. 1,369,269 (Colgate-Palmolive Company) discloses a process for dry neutralizing a synthetic organic anionic detergent acid with a particulate neutralizing agent, for example, carbonate, under high shear mixing conditions. The product made is finally divided and free-flowing, and may be blended directly with other detergent materials, or further reduced in particle size as necessary to suit the final product requirements.

A slightly different process for preparing high-density detergent products is disclosed in JP 60-072999A (Kao) wherein detergent sulfonic acid, sodium carbonate and water are mixed in a high-shearing apparatus to produce a solid mass which is further pulverized into a fine powder and then granulated into the desired high-density detergent product.

Alkyl sulfate surfactant is a valuable anionic surfactant in detergent products, particularly when used in combination with another anionic detergent surfactant such as alkylbenzene sulfonate surfactant. Processing of alkyl sulfate surfactants into detergent products can sometimes be problemsome when the alkyl sulfate is exposed to acidic conditions, since the alkyl sulfate surfactant can undergo unwanted hydrolysis to fatty alcohol.

Various methods of incorporating alkyl sulfate surfactant into high density, high active detergent products have been suggested, none of which are completely satisfactory. For example, the above mentioned Kao Publication JP 60-072999A discloses the incorporation with the detergent acid of the alkyl sulfate in liquid form. The mixing of the alkyl sulfate with the acid complicates the handling of the material, and will result in some appreciable level of reversion of the alkyl sulfate to the corresponding fatty alcohol by acid-catalyzed hydrolysis. Commonly assigned U.S. patent application Ser. No. 364,721, filed Jun. 9, 1989 (Muellar et al), now U.S. Pat. No. 5,152,932, discloses a process for producing high active detergent particles comprising the steps of continuously reacting alkyl sulfonic acid and/or alkylbenzene sulfonic acid with concentrated alkali metal hydroxide solution to produce a neutralized product with less than about 12% water, adding thereto a polyethylene glycol or ethoxylated nonionic surfactant, and forming detergent particles therefrom.

The alpha-sulfonated fatty acid alkyl ester surfactant is also useful as a detergent surfactant. This surfactant is attractive since it can be prepared partly or wholly from natural, renewable, non-petrochemical feedstocks and since it has good cleaning power without being sensitive to calcium ion in wash solutions. Alpha-sulfonated fatty acid alkyl ester can be used with other detergent surfactants, including anionic surfactants such as alkylbenzene sulfonate and alkyl sulfate surfactants. It is known that alpha-sulfonated fatty acid alkyl ester salts are susceptible to hydrolysis during their production, processing, and storage. Under alkaline conditions greater than about pH 10, the ester can undergo irreversible hydrolysis to the disalt of alpha-sulfo fatty acid, and the corresponding fatty alcohol. Under acidic conditions (less than about pH 6) as well, and in the presence of moisture, the ester can undergo reversible hydrolysis to the disalt and fatty alcohol. The disalt is weakly soluble in water and possesses only poor washing and cleansing power. Conventional methods of incorporating alpha-sulfonated fatty acid alkyl ester into heavy duty granular detergent products are not completely successful. As described in U.S. Pat. No. 4,416,809 (Magari et al, Nov. 22, 1983), the slurrying and spray drying at high temperature of compositions containing alpha-sulfonated fatty acid ester in the presence of strong alkaline builder, including sodium silicate and sodium carbonate, can result in hydrolysis of the ester and high levels of the undesirable disalt in the product.

Another useful detergent surfactant is polyhydroxy fatty acid amide. This surfactant is also attractive as derivable from natural, renewable, non-petrochemical sources. Examples of such polyhydroxy fatty acid amides are described in copending U.S. patent application Ser. No. 07/589,740 filed Sep. 28, 1990, now U.S. Pat. No. 5,494,982, incorporated herein by reference. The polyhydroxy fatty acid amide surfactant can be used in a granular detergent product along with other detergent surfactants, particularly anionic surfactants such as alkylbenzene sulfonate and alkyl sulfate surfactants. It is known that amides, much like esters, undergo hydrolysis in both acidic and alkaline conditions. Under alkaline conditions of greater than about pH 11, and under acidic conditions of less than about pH 3 and in the presence of moisture, the amide can be hydrolized irreversibly to the corresponding amine and fatty carboxylate salt (or fatty acid). These hydrolysis products are not as useful for cleaning as the amide surfactant, and are in fact highly undesirable in the final product. Since a very low level of amine can produce malodor in the product, hydrolysis of the polyhydroxy fatty acid amide should be completely avoided.

As used hereinafter, the term "pH sensitive detergent surfactant" refers to alkyl sulfate, alpha-sulfonate fatty acid alkyl ester, and polyhydroxy fatty acid amide, and mixtures thereof. The surfactant can undergo undesirable hydrolysis under acidic pH conditions, particular at a pH of less than about 6 and in the presence of moisture, and under alkaline pH conditions, particularly above about pH 9.

SUMMARY OF THE INVENTION

The present invention is of a method of preparing a high-density granular detergent composition. The composition comprises a mixture of linear or branched chain alkylbenzene sulfonate and at least one pH sensitive detergent surfactant, preferably selected from the group consisting of alkyl sulfate, alpha-sulfonated fatty acid alkyl ester, polyhydroxy fatty acid amide, and mixtures thereof. The method comprises the prior addition of the pH sensitive detergent surfactant in a solid particle form in the step of dry neutralizing the conjugate sulfonic acid of the alkylbenzene sulfonate with a particulate water-soluble alkaline inorganic material, typically sodium carbonate.

The present invention also comprises a granular detergent composition and a detergent product made by this process. The resultant high-density product has good product homogeneity and good surfactant solubility in water. The resultant product also has negligible levels of hydrolysis products of these pH sensitive detergent surfactants as a result of the dry neutralization of the alkylbenzene sulfonic acid. In the case of alkyl sulfate, the hydrolysis product is fatty alcohol; for alpha-sulfonated fatty acid alkyl ester, the hydrolysis products are the disalt of alpha-sulfonic fatty acid and alcohol; and for polyhydroxy fatty acid amide, the hydrolysis products are the corresponding amine and the fatty carboxylate salt (or fatty acid).

DETAILED DESCRIPTION OF THE INVENTION

As used hereinafter, the pH sensitive detergent surfactant in particle form may be generically referred to as "particulate surfactant"; and the water-soluble alkaline inorganic material may be generically referred to as "carbonate".

The Granular Detergent Composition

The present invention comprises a granular detergent composition comprising:

(1) from about 5% to about 50%, preferably from about 5% to about 30%, most preferably from about 8% to about 20%, by weight alkylbenzene sulfonate;

(2) from about 2% to about 40%, preferably from about 5% to about 25%, by weight pH sensitive detergent surfactant selected from the group consisting of alkyl sulfate, alpha-sulfonated fatty acid alkyl ester, polyhydroxy fatty acid amide, and mixtures thereof;

(3) from about 5% to about 80%, preferably about 20% to about 70%, most preferably about 30% to about 70%, by weight hydratable inorganic detergent builder; and (4) from about 5% to about 70%, preferably from about 10% to about 40% by weight water-soluble alkaline inorganic material.

The alkylbenzene sulfonate is formed by a step of dry neutralizing alkylbenzene sulfonic acid with the water-soluble alkaline inorganic material. The pH sensitive detergent surfactant is incorporated in the granular detergent composition as particles in the dry neutralization step.

The alkylbenzene sulfonate has a linear or branched alkyl chain of from about 8 to 20 carbon atoms, preferably from 10 to 16 carbon atoms, most preferably from 10 to 13 carbon atoms The alkyl sulfate surfactant also includes alkyl ether sulfate, and has the general formula $R^1—(E)_n—OSO_3M$, wherein $R^1$ is alkyl containing from 8 to 22 carbon atoms, preferably from 14 to 18 carbon atoms; E is the moiety $—(OCH_2CH_2)—$; n is from 0 to 20; preferably 0 to 10, and most preferably 0; and M is selected from the group consisting of Na, K, Li, and mixtures thereof, most preferably Na.

The alpha-sulfonated fatty acid alkyl ester surfactant has the general formula

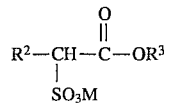

where in $R^2$ is alkyl having from 8 to 20 carbon atoms; $R^3$ is alkyl having from 1 to 4 carbon atoms; and M is selected from the group consisting of Na, K, Li and $NH_4$, and mixtures thereof. Preferred is an ester salt wherein $R^2$ is $C_{16}$–$C_{18}$ alkyl, $R^3$ is methyl, and M is Na. Alpha-sulfonated fatty acid alkyl ester may hereinafter be generically referred to as "alkyl ester sulfonate".

The polyhydroxy fatty acid amide surfactant has the general formula

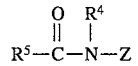

wherein $R^4$ is H, $C_1$–$C_4$ hydrocarbyl, 2-hydroxy ethyl, 2-hydroxy propyl, or a mixture thereof; $R^5$ is $C_5$–$C_{31}$ hydrocarbyl, preferably straight chain $C_7$–$C_{19}$ alkyl or alkenyl, more preferably $C_{11}$–$C_{15}$ alkyl or alkenyl or mixture thereof; and Z is a polyhydroxyhydrocarbyl having a linear chain with at least 3 hydroxyls directly connected thereto, a hydro derivative derived by dehydration of such polyhydroxyhydrocarbyl, or an alkoxylated derivative, preferably ethoxylated or propoxylated thereof. Z is preferably derived from a reducing sugar such as glucose, fuctose, maltose, lactose, galactose, mannose, and xylose. Z is more preferably selected from the group consisting of $—CH_2—(CHOH)_n—CH_2OH$, $—CH(CH_2OH)—(CHOH)_{n-1}—CH_2OH$, $—CH_2—(CHOH)_2—(CHOR^6)—(CHOH)—CH_2OH$, and alkoxylated derivatives thereof, wherein n is an integer from 3 to 5, inclusive, and $R^6$ is H or a cyclic or aliphatic monosaccharide, and is most preferably polyhydroxyl wherein n is 4. A preferred polyhydroxy fatty acid amide is N-cocoyl N-methyl glucamide.

The detergent builder is preferably selected from the group consisting of sodium tripolyphosphate, tetrasodium pyrophosphate, sodium carbonate, alkali metal aluminosilicate, and mixtures thereof. The most preferred hydratable builder is sodium tripolyphosphate. The aluminosilicates can be crystalline or amorphous in structure and can be either naturally occurring or synthetically derived. Preferred synthetic crystalline aluminosilicate ion exchange materials useful herein are available under the designations Zeolite A, Zeolite B, and Zeolite X. In an especially preferred embodiment, the crystalline aluminosilicate ion exchange material is Zeolite A and has the formula:

$$Na_{12}[(AlO_2)_{12}\cdot(SiO_2)_{12}]\cdot xH_2O$$

wherein x is from about 20 to about 30, especially about 27.

The water-soluble alkaline inorganic material can be alkali metal carbonate or alkali metal bicarbonate, though preferably sodium carbonate, potassium carbonate, lithium carbonate, and mixtures thereof; and most preferably, sodium carbonate.

The granular detergent compositions can be formulated so that the hydratable inorganic detergent builder and the water-soluble alkaline inorganic material are the same component, for example, sodium carbonate, and comprise from about 10% to about 70% by weight of the granular detergent composition.

Optional Ingredients

Other ingredients commonly used in detergent compositions can optionally be incorporated into the granular detergent compositions of the present invention. The following are representative of such materials, but are not intended to be limiting.

Water-soluble salts of the higher fatty acids (i.e., "soaps") are useful as auxiliary surfactants. This class of surfactants includes ordinary soaps such as the sodium, potassium, ammonium and alkanolammonium salts of higher fatty acids. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Other auxiliary surfactants include sodium alkyl glyceryl ether sulfates, especially those ethers of higher alcohols derived from tallow and coconut oil; sodium coconut oil fatty acid monoglyceride sulfonates and sulfates; and sodium or potassium salts of alkyl phenol ethylene oxide ether sulfates.

Another auxiliary surfactant is water-soluble nonionic synthetic surfactant, broadly defined as a compound produced by the condensation of ethylene oxide (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements.

Other auxiliary surfactants include water-soluble amine oxides, water-soluble phosphine oxide surfactants, water-soluble sulfoxide surfactants, ampholytic surfactants which include aliphatic derivatives of heterocyclic secondary and tertiary amines, zwitterionic surfactants which include derivatives of aliphatic quaternary ammonium, phosphonium and sulfonium compounds, water-soluble salts of olefin sulfonates, and beta-alkyloxy alkane sulfonates.

It is to be recognized that any of the foregoing auxiliary surfactants can be used separately, or in mixtures of surfactants, at levels of from about 2% to about 30% by weight of the detergent granules.

In addition to the auxiliary surfactants mentioned above, a hydrotrope, or mixture of hydrotropes, can be present in the detergent granules. Preferred hydrotropes include the alkali metal, preferably sodium, salts of toluene sulfonate, xylene sulfonate, cumene sulfonate, and sulfosuccinate. Preferably, the hydrotrope, in either the acid form or the salt form, and being substantially anhydrous, is added to the alkylbenzene sulfonic acid prior to its dry neutralization. The hydrotrope is preferably present at from about 0.5% to about 5% by weight of the detergent granules.

Auxiliary detergent builders which can be used include alkali metal (e.g., sodium and potassium) bicarbonates and silicates, and water-soluble organic detergency builders, for example alkali metal, ammonium and substituted ammonium polycarboxylates. Specific examples of useful polycarboxylate builder salts include sodium, potassium, ammonium and substituted ammonium salts of ethylenediaminetetraacetic acid, nitrilotriacetic acid, oxydisuccinic acid, mellitic acid, benzene polycarboxylic acid, polyacrylic acid, polymaleic acid, and citric acid. Other useful polycarboxylate detergency builders are the materials set forth in U.S. Pat. No. 3,308,067 issued to Diehl on Mar. 7, 1967, incorporated herein by reference.

Another useful optional component of the detergent granules is silicate, especially sodium silicate. Sodium silicate can be used at up to about 10% silicate solids having a weight ratio of $SiO_2$ to $Na_2O$ between about 1.6:1 and about 3.4:1.

Sodium sulfate is a well-known material that is compatible with the compositions of this invention. It can be a by-product of the surfactant sulfation and sulfonation processes, or it can be added separately.

Other optional ingredients include soil suspending agents such as water-soluble salts of carboxymethylcellulose and carboxyhydroxymethylcellulose, polyethylene glycols having a molecular weight of about 400 to 10,000, bleaches and bleach activators, enzymes, clays, soil release agents, dyes, pigments, optical brighteners, germicides, and perfumes.

The Detergent Granule Making Process

The present invention involves a process for preparing a high-density granular detergent composition, comprising the steps of:

A. forming a particulate composition comprising a pH sensitive detergent surfactant in particle form, water-soluble alkaline inorganic material, and a hydratable inorganic detergent builder;

B. mixing and shearing the particulate composition so that the particulate composition is partially fluidized; and C. dispersing an alkylbenzene sulfonic acid, which is the conjugate acid of the alkylbenzene sulfonate, into the partially fluidized particulate composition, thereby essentially completely neutralizing the alkylbenzene sulfonic acid to alkylbenzene sulfonate and forming the granular detergent composition.

The pH sensitive detergent surfactant is selected from the group consisting of alkyl sulfate, alpha-sulfonated fatty acid alkyl ester, polyhydroxy fatty acid amide, and mixtures thereof.

Step A is the forming of a particulate composition comprising the pH sensitive detergent surfactant in particle form, the water-soluble alkaline inorganic material, and the hydratable inorganic detergent builder.

The particulate surfactant can comprise from 50% to 100%, preferably from about 75% to 98%, by weight of the surfactant active, and some amount, preferably less than about 25%, more preferably less than about 10%, and most preferably from about 1% to 5%, by weight unreacted starting material (for example, fatty alcohol in the case of alkyl sulfate, and salts of fatty acid in the case of alpha-sulfonated fatty acid ester) and by-products from their manufacture, processing, and storage.

In the case of alkyl sulfate, the present invention can avoid the formation of any significant level (less than 5%, typically less than 2%, by weight of the surfactant particle) of fatty alcohol which can form by the acid-catalyzed hydrolysis of the alkyl sulfate on the surface of the surfactant particle. High levels of fatty alcohol on the surface of the surfactant particle can serve as an efficient but undesirable agglomeration binder, which can lead to excessive oversized product and/or sticky, cakey product.

In the making of alkyl sulfate and alkyl ether sulfate, the alkyl moiety can be derived naturally (for example, from coconut oil) or synthetically (for example, by the Ziegler process). The alkyl sulfate is derived by the well-known sulfation process, such as the oleum or $SO_3$ gas processes, followed by neutralization. The alkyl ether sulfate can be made by the condensation, by known methods, of ethylene oxides on monohydric fatty alcohol, followed by sulfation and neutralization. Buffering agents can be employed at up to 10%, preferably from 1% to 5%, by weight of the alkyl sulfate to improve stability. Such buffering agents include alkali metal salts of bicarbonate, carbonate, citric acid, acetic and maleic acid, as well as others which have a pKa in the range of about 6 to 9.

Alpha-sulfonated fatty acid ester is also prepared by well-known processes. Fatty acid esters can be sulfonated by using $SO_3$ as the sulfonating agent under conditions which minimize cleavage of the ester linkage, which are easily determined by those skilled in the art. The resulting alpha-sulfonic acid fatty acid ester can be neutralized and bleached (to reduce the dark color typical of such materials) by well-known processes, such as those described in U.S. Pat. No. 4,404,143 (Sep. 13, 1983). Buffering agents, such as those described above, can be incorporated at levels up to 10%, preferably from 1% to 5%, by weight of the alkyl ester sulfonate to help stabilize the alkyl ester sulfonate against hydrolysis.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triiglyceride in a condensation/amidation step to form the N-alkyl, N-polyhydroxy fatty acid amide product.

The particulate surfactant can have a weight average particle size of from about 100 microns to 3500 microns, preferably from about 200 microns to 2000 microns. The pH sensitive detergent surfactant particles can be prepared by a number of well-known processes, such as spray drying, drum drying and flaking, followed by size reduction and/or screening as needed. The process selected must allow control of the surfactant particle size. In the case of alkyl sulfate surfactant, for example, the surfactant particle size distribution can effect the solubility of the surfactant in water, the product aesthetics and homogeneity, and the level of hydrolysis (reversion to fatty alcohol) of the alkyl sulfate surfactant active. Particles having an excessively small average particle size can result in an excessively dusty product, while particles having an excessively large average particle size can result in excessive segregation of the particulate surfactant in the product.

In a preferred method, the pH sensitive detergent surfactant particles are formed into the shape of a rod by using a radial or axial extruder, such as the Fugi Paudal EXD-180 radial extruder (Fugi Paudal Co., Ltd., Osaka, Japan). The shape of a rod, as compared to a flake, reduces the specific surface area of the surfactant particle exposed to the alkylbenzene sulfonic acid. In the, case of alkyl sulfate surfactant, for example, reduced surface area can reduce the amount of fatty alcohol formed by acid-catalyzed hydrolysis of the alkyl sulfate surfactant active. To make rods, the detergent surfactant is placed in a plodder and extruded into rods having a diameter from about 0.3 mm to about 2.0 mm and a length from about 0.5 mm to about 10 mm. The extruded particulate can be added directly into the dry neutralization equipment in Step A, or the rods can be reduced in size in separate equipment, for example to a length of from about 0.2 mm to about 5 mm, and then added into the particulate composition of Step A.

A highly preferred method of making rods involves the extrusion of high active (90% to 98% by weight) pH sensitive detergent surfactant, preferably alkyl sulfate, into particles having a diameter from 0.5 mm to 1.0 mm, and a length from about 0.5 mm to 5.0 mm, and addition of these surfactant particles directly into the particulate composition of Step A.

The particulate composition in Step A also includes the water-soluble alkaline inorganic material in particulate form. The preferred particulate water-soluble alkaline inorganic material is carbonate, preferably sodium carbonate, potassium carbonate, lithium carbonate, and mixtures thereof; and most preferably, sodium carbonate. The amount of alkaline inorganic material added in the process for making the granular detergent composition will also include that amount necessary to neutralize the alkylbenzene sulfonic acid which is added in Step C. The particulate carbonate used can vary from a powdered form having particles ranging from about 5 microns to about 100 microns, with a weight average particle size of from about 20 microns to about 60 microns, to a granular form having particles ranging from about 100 microns to 1500 microns with a weight average particle size of from about 300 microns to about 800 microns. The particular type of carbonate selected will effect the rate of neutralization, the size of the detergent granule formed in the process, and the stickiness and tackiness of the detergent granules. For example, the use of a more granular (larger particle size) carbonate material may result in slower neutralization, generally larger detergent granules with a higher amount of course material that may need to be further reduced in size or screened from the product, and relatively lower levels of alkylbenzene sulfonic acid loading, as compared to a fine powdered carbonate. Typically, higher levels of the alkylbenzene sulfonic acid can be employed using a fine powdered carbonate. It is within the skill of workers in the art to select the appropriate type or mixtures of carbonate stock to achieve the desired surfactant level and product particle size.

The particulate composition in Step A also includes the hydratable inorganic detergent builder in particulate form. The hydratable inorganic detergent builder is preferably selected from sodium tripolyphosphate, tetrasodium pyrophosphate, sodium carbonate, alkali metal alumina silicate, and mixtures thereof. The most preferred hydratable builder is sodium tripolyphosphate. An essential property of this material is its ability to hydrate free moisture, which may be generated during the neutralization of the alkylbenzene sulfonic acid. This prevents excessive free moisture buildup in the process which may lead to caking and dough formation. The hydratable builder stock may range from a powdered form to a granular form in the particle size ranges as defined above for the carbonate. The particle size of the hydratable builder can effect the processing and the resultant product quality in the same manner as with the particle size of the carbonate material. Again, it is within the skill of workers in the art to select the appropriate type or mixtures of hydratable builder stock to achieve the desired product quality.

Additional detergent components, as described earlier, can be incorporated into the process in Step A. Preferably, these components are dry or contain low levels of free water to avoid the problems associated with the free water as described above.

A neutralization additive can optionally be employed in Step A of the process. The additive is selected from sodium hydroxide, potassium hydroxide, lithium hydroxide, and mixtures thereof, and most preferably, sodium hydroxide. The neutralization additive is usually introduced in Step A in the form of an aqueous solution (for example, 50% aqueous NaOH) at a level (anhydrous basis) from about 0.1% to about 1.0% by weight of the detergent granules. The neutralization additive helps to increase the initial rate of neutralization of the alkylbenzene sulfonic acid with the carbonate, and is particularly useful in the neutralization of the branched chain alkylbenzene sulfonic acid.

Water, including the water introduced with the neutralization additive, can help to promote reaction of the alkylbenzene sulfonic acid with the carbonate neutralizing agent. However, in order to ensure that the product of the neutralization step remains in a particulate, free-flowing form, the amount of free water present in the particulate composition during the neutralization and in the final detergent granules is kept low, generally less than about 10% water, and typically from about 1% to 3% water, by weight of the detergent granules. Free water includes the water bound as water of hydration to inorganic materials which can release water of hydration at temperatures less than about 85° C.

The incorporation of the hydratable inorganic detergent builder and the low level of free water during the neutralization process help avoid excessive caking and dough formation, and prevent excessive agglomeration of the product so that further particle size reduction is unnecessary, though optional. The low moisture level also helps to prevent the acid-catalyzed hydrolysis of the pH sensitive detergent surfactant.

The various components of the particulate composition of Step A can be pre-mixed and metered together into the mixing and shearing equipment, or they can be individually metered into the equipment.

Step B is the mixing and shearing of the particulate components so that the particulate composition is partially fluidized. The mixing in Step B includes both any pre-mixing of the particulate composition before the addition of the alkylbenzene sulfonic acid, as well as continuous mixing during the addition of the sulfonic acid in Step C. In Step B, the pre-mixing of the particulate composition can take from 30 seconds to about 5 minutes, preferably from 30 seconds to about 3 minutes. The pre-mixing ensures that the ingredients of the particulate composition, most importantly the alkaline inorganic material, are well blended prior to the addition of the alkylbenzene sulfonic acid. During the pre-mixing, the input of energy due to the mixing and shearing can raise the temperature of the particulate composition by about 1° C.

The equipment selected to mix and shear the particulate composition must also be capable of providing thorough mixing in order to prepare and maintain a homogeneous particulate composition during the neutralization reaction. The equipment must also be capable of fluidizing the particulate composition in the vicinity where the alkylbenzene sulfonic acid is dispersed. As used herein, the term "fluidize" means the state of mechanical agitation where the mass of particles to some extent become aerated, but does not require the use of any fluid or gas to provide such aeration. The preferred equipment for use in the process of this invention is the V-Blender (Patterson-Kelley, East Stroudsburg, Pa., U.S.A.). V-Blenders are commercially available in a variety of sizes, from a small laboratory unit (8-quart or -liter) to production sized units (50-ft$^3$ and larger). Particularly preferred is the 50-ft$^3$ (1400 liter) V-Blender. The operation of the V-Blender will be discussed hereinafter.

Step C is the dispersing of an alkylbenzene sulfonic acid into the partially fluidized particulate composition, resulting in the essentially complete neutralization of the alkylbenzene sulfonic acid to form the corresponding alkylbenzene sulfonate surfactant, and in the formation of the granular detergent composition.

Alkylbenzene sulfonic acid can be made by well-known processes, typically by the oleum sulfonation or $SO_3$–$SO_2$ sulfonation of alkylbenzene. The alkylbenzene sulfonic acid material can contain from about 85% to about 98% sulfonic acid active, from about 0.5% to about 12% sulfuric acid, and from about 0% to about 5% water. The presence of some water in the alkylbenzene sulfonic acid can promote the neutralization of the acid by the alkaline inorganic material.

Dispersion of the alkylbenzene sulfonic acid into the partially fluidized particulate composition can be achieved by a number of means, such as a two fluid (acid solution and gas) spray nozzle, a single fluid (acid solution only) spray nozzle, or a spinning disk atomizer. The spray or atomization conditions and sulfonic acid conditions (including temperature and spray-on rate) are selected to achieve effective atomization of the alkylbenzene sulfonic acid into fine droplets. Effective atomization insures essentially complete neutralization of the sulfonic acid by the alkaline inorganic material without excessive buildup of non-neutralized alkylbenzene sulfonic acid in the reaction mixture or on the internal surfaces of the apparatus. Large non-neutralized alkylbenzene sulfonic acid droplets can serve as an agglomerating agent and lead to unacceptably large detergent particles. Also the presence of significant amounts of non-neutralized alkylbenzene sulfonic acid in the reaction mixture of the particulate composition can accelerate the hydrolysis of the pH sensitive detergent surfactant active, as discussed earlier.

A preferred process utilizes the 50-ft$^3$ V-blender apparatus described above. This is a twin shell blender with two simple cylinders formed to shape a "V". The shell is filled with particulate and/or powder from about 40% to 70% of the total volume. The shell rotates slowly around a center axis mid-way up the "V", thereby tumbling the particulate product, splitting it, and recombining it. Generally the V-Blender will be operated at a shell rotation speed of about 10 revolutions per minute (RPM) to about 35 RPM. In the 50-ft$^3$ V-blender, the preferred rotation speed ranges from 12 RPM to 15 RPM.

An intensifier bar rotates through the center axis inside the V-Blender. The intensifier bar provides for good atomization of the alkylbenzene sulfonic acid and for fluidization of the particulate composition in the vicinity of the dispersed detergent acid. The intensifier bar is hollow with two or more dispersion disks with blades attached along its length, and rotates at high blade tip speed (3000 ft/min to 5000 ft/min, or 914 meter/min to 1524 meter/min). The alkylbenzene sulfonic acid is added through the intensifier bar and exists from the dispersion disks as fine droplets due to centripetal force. Droplet size and rate can be controlled to some extent by adjusting the shim gap of the intensifier dispersion disks. The intensifier bar mechanically fluidizes the tumbling particulate composition in the vicinity of the dispersed alkylbenzene sulfonic acid. The result is an unimpeded dispersion of the alkylbenzene sulfonic acid with the fluidized powders and good liquid-powder contact.

The addition and dispersion of the alkylbenzene sulfonic acid into the particulate composition will generally take from about 5 minutes to about 100 minutes for each batch of granular detergent composition made, depending on the type and size of equipment selected, the amount of sulfonic acid used, and other factors. For the 50-ft$^3$ V-Blender, the addition and dispersion will take from 10 minutes to 50 minutes, preferably from about 15 minutes to about 35 minutes. During this time, the reaction mixture, which includes the initial components of the particulate composition as well as the resulting detergent granules formed during the neutralization of the alkylbenzene sulfonic acid, will experience a temperature rise of about 20°–70° C. Some amount of heat can also be generated as the inorganic detergent builder is hydrated by the free water formed as a result of the neutralization reaction. So long as the level of free moisture in the reaction mixture remains low (e.g., less than about 10%), and so long as the alkylbenzene sulfonic acid is well dispersed and is neutralized without excessive buildup in the product mixture, reaction mixture temperatures up to about 85° C. are acceptable, and do not appear to have any adverse effects on the neutralization reaction, the properties of the granular detergent composition, or on the stability of the pH sensitive detergent surfactant.

After the complete addition of the alkylbenzene sulfonic acid, other optional detergent materials can be added to the resultant detergent granules. Such materials can include a free flow aid such as crystalline or amorphous alkali metal aluminosilicate, calcium carbonate, clay, and mixtures thereof. The free flow aid can be most effective when added immediately after the neutralization of the sulfonic acid, which allows the mixer to uniformly disperse it in the product. The free flow aid can optionally be added with the particulate composition of Step A. The free flow aid can be added at a level of from 0% to 20%, preferably from 2% to 10%, by weight of the detergent granules.

Other optional materials include perfume, bleach and bleach activator, clay, enzymes, etc., which are preferably added to the detergent granules after the detergent granules have been discharged from the apparatus and cooled or allowed to cool to a temperature of approximately 40° C. or less.

The optional materials can be incorporated into the process at any suitable stage depending on their form, and a person skilled in this art will not have any difficulty in determining whether the ingredient can be incorporated into the neutralization step, or should be added to the product after the formation of the detergent granules.

The granular detergent composition made by this process generally has a weight average particle size of from about 100 microns to about 1500 microns, with a mean particle size of from about 300 microns to about 700 microns, and a bulk composition density of from about 600 g/l (grams per liter) to about 1000 g/l, most preferably from about 700 g/l to about 900 g/l. The individual detergent granules themselves made by this process have a particle density from about 1200 g/l to about 2000 g/l, most preferably from about 1400 g/l to about 1800 g/l. The individual particle density and the bulk composition density are significantly higher than those of detergent granules and granular detergent compositions made by the conventional spray drying process, which typically have a bulk density from about 250 g/l to about 500 g/l, and an individual particle density from about 500 g/l to 1000 g/l.

As previously mentioned, the granular detergent compositions and detergent products made therefrom have good product homogeneity and surfactant solubility in water, especially cold water. The excellent contacting of the liquid alkylbenzene sulfonic acid with the powdered carbonate minimizes the amount of, and the time during which, the alkylbenzene sulfonic acid is exposed to the pH sensitive detergent surfactant. In the case of alkyl sulfate, a negligible level of fatty alcohol is formed as a result of the reversion of the alkyl sulfate due to acid-catalyzed hydrolysis in the presence of the sulfonic acid. In the case of alkyl ester sulfonate and polyhydroxy fatty acid amide, negligible levels of the disalt and amine, respectively, are formed. Incorporating surfactant particles in the neutralization step to make the detergent product also minimizes undesirable segregation of the surfactant particle, compared to product where the surfactant particles are merely added to the detergent granules.

In the case of alkyl sulfate, it has been found that the solubilities of the alkyl sulfate and alkylbenzene sulfonate surfactants are improved in water (particularly cold water from 10° C. to 30° C.) when the alkyl sulfate particle is incorporated in the dry neutralization step. This results in more rapid dissolving of the surfactant in the wash solution, and consequently can provide more effective cleaning. Without being bound by any particular theoretical consideration, it is believed that the incorporation of the alkyl sulfate surfactant particles in the neutralization step results in partial softening of the surfactant particles as the temperature of the particulate composition and reaction product increases due to the heat of neutralization. The softened alkyl sulfate surfactant particles adhere to the carbonate and builder particulate in the particulate composition, which can help to prevent their segregation in the product, as well as assist in dispersing the surfactants into the wash solution.

The granular detergent composition made by the present process can be used directly as a detergent product or as a component in a detergent product without requiring significant particle size reduction or classification. The granular detergent composition can comprise from about 50% to 98% by weight of a final granular detergent product. The granular detergent composition can also be used as a feed stock material in the production of synthetic laundry bars by well-known processes, such as that described in U.S. Pat. No. 3,178,370 (Apr. 13, 1965), incorporated herein by reference.

The invention is illustrated by the following non-limiting examples. All parts and percentages herein are by weight unless otherwise stated.

EXAMPLE I

A 1,175 kg batch of high bulk density granular detergent was prepared containing 27.6% total anionic surfactant in a 60:40 ratio of branched $C_{12}$ alkylbenzene sulfonate and coconut fatty alcohol sulfate. The composition is detailed below.

| | Weight % |
|---|---|
| Branched $C_{12}$ Alkylbenzene Sulfonate | 16.5 |
| Coconut Fatty Alcohol Sulfate | 11.1 |
| Sodium Carbonate | 32.0 |
| Sodium Tripolyphosphate | 27.6 |
| Sodium Sulphate | 4.3 |
| Zeolite A (detergent grade, hydrated) | 2.2 |
| Sodium Hydroxide (50% aqueous solution) | 0.5 |
| Minor Components and miscellaneous | 1.5 |
| Moisture and sodium bicarbonate formed | 4.3 |
| | 100.0% |

A 1,400-liter Patterson-Kelley twin shell blender with a liquid addition intensifier bar was charged with all the components except the alkylbenzene sulfonate and zeolite, with the sodium hydroxide solution added last. The sodium carbonate and sodium tripolyphosphate used were finely ground (weight average particle size of about 75 microns each). The coconut alkyl sulfate was charged as particles containing 92% active and 1.66% fatty alcohol, and having the shape of a rod of approximately 1 mm diameter and 2 to 5 mm length. The blender shell was then rotated at 15 rpm. After a 10 second delay, the intensifier bar was started. After a 3 minute premix period, C12 alkylbenzene sulfonic acid was injected into the intensifier bar at a rate of 10.8 kg/minute using a gear pump. A predetermined total acid injection time of 18 minutes was used, with the bar spinning an additional minute to clear it of residual sulfonic acid. The mixer was stopped and the zeolite was then added. The shell and intensifier bar were then rotated for an additional three minute mixing period to disperse the zeolite before the blender was emptied. The final batch temperature was 63° C.

The operating conditions achieved atomization of the acid mix and effective mixing and shearing of the powders. The tip speed of the intensifier bar blade was 1,000 meters/minute. A shim gap of 500 microns was used in the liquid dispersion disks of the intensifier bar. The sulfonic acid was preheated to 75° C. before injection to reduce its surface tension and viscosity and ensure good atomization.

The resulting detergent product was fine and free flowing, with 92% by weight of the product having a particle size less than 1170 microns. This predominate fraction had a bulk density of 820 grams/liter and a weight average particle size of 260 microns. Essentially complete analytical recovery of the alkyl sulfate surfactant was obtained by cationic $SO_3$ titration before and after forced hydrolysis of the AS fraction of the surfactant, indicating negligible hydrolysis of the alkyl sulfate to fatty alcohol.

EXAMPLE II

A 250 kg batch of a high bulk density granular detergent similar to that in Example 1 was prepared. In this case, 75:25 ratio of linear $C_{11.8}$ alkylbenzene sulfonate and coconut fatty alcohol sulfate was used with a total surfactant level of 27.8%. The composition is detailed below.

| | Weight % |
|---|---|
| Linear $C_{11.8}$ Alkylbenzene Sulfonate | 20.8 |
| Coconut Fatty Alcohol Sulfate | 7.0 |
| Sodium Carbonate | 28.4 |
| Sodium Tripolyphosphate | 27.8 |
| Zeolite A (detergent grade, hydrated) | 8.0 |
| Minor Components and miscellaneous | 1.7 |
| Moisture and Sodium Bicarbonate formed | 6.3 |
| | 100.0% |

A 280-liter Patterson-Kelley twin shell blender was used with a procedure similar to that used for the larger blender of Example 1. For this formulation, half of the zeolite (4%) was added initially with the other powders before dry neutralization. The sodium carbonate had a weight average particle size of about 50 microns, and the sodium tripolyphosphate had a weight average particle size of about 110 microns. The alkyl sulfate particles contained 92% active and about 2.5% free fatty alcohol, and had the shape of a rod of approximately 1 mm diameter and 2 to 5 mm length. The premix and post-mix times were each 0.5 minutes, the sulfonic acid injection rate was 4.4 kg/minute for 12 minutes, the intensifier blade tip speed was 1,280 meters/minute, the liquid dispersion disk shim gap was 760 microns, and the sulfonic acid was preheated at 66° C. before injection. The remaining zeolite was added after all the sulfonic acid was added, followed by 5 minutes of additional blending to disperse the zeolite.

The detergent product yielded 85% by weight of particles smaller that 1170 microns; this predominate fraction had a bulk density of 830 grams/liter and a weight average particle size of 420 microns. Again, essentially complete analytical recovery of the alkyl sulfate surfactant was obtained, indicating negligible hydrolysis of the alkyl sulfate to fatty alcohol.

What is claimed is:

1. A process for making a high-density granular detergent composition comprising the steps of:

(a) forming a particulate composition comprising:

(i) a pH sensitive detergent surfactant in particulate form having a weight average particle size of from about 200 microns to about 2000 microns, the pH sensitive detergent surfactant comprising from 50% to 100% surfactant active by weight, and the pH sensitive detergent surfactant being selected from the group consisting of:

(A) alkyl sulfate having the general formula $R^1—(E)_n—OSO_3M$, wherein:

(I) $R^1$ is alkyl containing from 8 to 22 carbon atoms, (II) E is the moiety $—(OCH_2CH_2)$ (III) n is an integer from 0 to 20, and (IV) M is selected from the group consisting of Na, K, Li, or a mixture thereof;

(B) alpha-sulfonated fatty acid alkyl ester of the formula

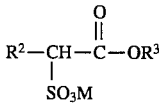

wherein:

(I) $R^2$ is alkyl having from 8 to 20 carbon atoms (II) $R^3$ is alkyl having from 1 to 4 carbon atoms, and (III) M is selected from the group consisting of Na, K, Li, $NH_4$, or a mixture thereof;

(C) polyhydroxy fatty acid amide of the formula

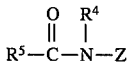

wherein:

(I) $R^4$ is selected from the group consisting of H, $C_1$–$C_4$ hydrocarbyl, 2-hydroxy ethyl, 2-hydroxy propyl, or a mixture thereof;

(II) $R^5$ is straight chain $C_7$–$C_{19}$ alkyl or alkenyl; and (III) Z is selected from the group consisting of a polyhydroxyhydrocarbyl having a linear chain with at least 3 hydroxyls directly connected thereto, a hydro derivative derived by dehydration of such polyhydroxyhydrocarbyl, or an alkoxylated derivative; or (D) a mixture thereof;

(ii) a water-soluble alkaline inorganic material selected from the group consisting of:

(A) alkali metal carbonates, (B) alkali metal bicarbonates, or (C) a mixture thereof; and (iii) a hydratable inorganic detergent builder selected from the group consisting of:

(A) sodium tripolyphosphate,
(B) tetrasodium pyrophosphate,
(C) alkali metal aluminosilicates, or
(D) a mixture thereof;

(b) mixing and shearing the particulate composition such that the particulate composition is partially fluidized; and (c) dispersing, into the partially fluidized particulate composition, alkylbenzene sulfonic acid containing from about 85% to about 98% sulfonic acid active, the dispersion being done under conditions to achieve atomization of the alkylbenzene sulfonic acid into fine droplets, thereby essentially completely neutralizing the alkylbenzene sulfonic acid to form its corresponding alkylbenzene sulfonate surfactant, and forming the granular detergent composition;

wherein:

(α) the granular detergent composition made by the process has a bulk composition density of from about 600 g/l to about 1000 g/l;

(β) the granular detergent composition made by the process contains less than 5% by weight hydrolysis products of the pH sensitive detergent surfactant:

(1) hydrolysis product of the alkyl sulfate being the corresponding fatty alcohol;

(2) hydrolysis products of the alpha-sulfonated fatty acid ester being the corresponding disalt of alpha-sulfonic fatty acid and the corresponding alcohol; and (3) hydrolysis products of the polyhydroxy fatty acid amide being the corresponding amine, the corresponding fatty carboxylate salt, and the corresponding fatty acid.

2. The process of claim 1 wherein the water-soluble alkaline inorganic material is sodium carbonate.

3. The process of claim 2 wherein the pH sensitive detergent surfactant is alkyl sulfate, and wherein less than 2% by weight of the alkyl sulfate surfactant active reverts to free fatty alcohol during or after the neutralization of the alkylbenzene sulfonic acid as a result of acid-catalyzed hydrolysis.

4. The process of claim 3 wherein $R^1$ is $C_{14}$–$C_{18}$ alkyl, n is 0, and wherein the alkylbenzene sulfonate has a linear or branched alkyl chain containing from 10 to 16 carbon atoms.

5. The process of claim 4 wherein the sodium carbonate has a weight average particle size of from about 20 microns to about 60 microns.

6. The process of claim 5 wherein, in the granular detergent composition, the level of alkyl sulfate is from about 5% to 25%, and the level of alkylbenzene sulfonate is from about 5% to 30%.

7. The process of claim 6 wherein the alkyl sulfate surfactant in particulate form in Step (a) comprises from 90% to 98% alkyl sulfate surfactant active, and from 1% to 5% of its conjugate free fatty alcohol.

8. The process of claim 1 wherein, in Step (b), the particulate composition is tumbled, split and recombined, and the particulate composition is mechanically fluidized in the vicinity of the dispersed alkylbenzene sulfonic acid of Step (c).

9. The process of claim 6 wherein, in Step (b), the particulate composition is tumbled, split and recombined, and the particulate composition is mechanically fluidized in the vicinity of the dispersed alkylbenzene sulfonic acid of Step (c).

10. A granular detergent composition made according to the process of claim 1, wherein the detergent composition comprises:

(1) from about 5% to about 50% by weight alkylbenzene sulfonate surfactant having a linear or branched alkyl chain containing from 10 to 16 carbon atoms;

(2) from about 2% to about 40% by weight pH sensitive detergent surfactant;

(3) from about 5% to about 80% hydratable inorganic detergent builder; and (4) from about 5% to about 70% water-soluble alkaline inorganic material.

11. The, granular detergent composition of claim 10 wherein the water-soluble alkaline inorganic material is sodium carbonate.

12. The granular detergent composition of claim 11 wherein the pH sensitive detergent surfactant particles are in the shape of a rod having a diameter from about 0.5 mm to about 1.0 mm, and a length from about 0.5 mm to about 5 mm.

13. The granular detergent composition of claim 10 wherein the pH sensitive detergent surfactant particles comprise from 1% to 5% by weight of the particle of a pH buffering agent which has a pKa in the range of 6–9, the buffering agent being in addition to the water-soluble inorganic material.

14. The granular detergent composition of claim 12 wherein the pH sensitive detergent surfactant is alkyl sulfate at a level of from about 5% to 25%, and the level of the alkylbenzene sulfonate is from about 5% to 30%.

15. The granular detergent composition of claim 10 wherein the composition has a weight average particle size from about 100 microns to about 1500 microns.

16. The granular detergent composition of claim 14 wherein the composition has a weight average particle size from about 100 microns to about 1500 microns.

17. A detergent product comprising:

(a) from about 50% to about 98% by weight of the granular detergent composition according to claim 10, and (b) from about 2% to about 50% by weight of conventional ingredients comprising one or more of: auxiliary surfactants in addition to those present in the granular detergent composition, builders in addition to those present in the granular detergent composition, soil suspending agents, bleaches and bleach activators, enzymes, soil release agents, dyes, pigments, optical brighteners, germicides and perfumes.

18. The detergent product of claim 17 in the form of a synthetic laundry bar.

19. A detergent product comprising:

(a) from about 50% to about 98% by weight of the granular detergent composition according to claim 16; and (b) from about 2% to about 50% by weight of conventional ingredients comprising one or more of: auxiliary surfactants in addition to those present in the granular detergent composition, builders in addition to those present in the granular detergent composition, soil suspending agents, bleaches and bleach activators, enzymes, soil release agents, dyes, pigments, optical brighteners, germicides and perfumes.

20. The detergent product of claim 19 in the form of a synthetic laundry detergent bar.

* * * * *